United States Patent [19]

Yamori et al.

[11] Patent Number: 4,833,116

[45] **Date of Patent: * May 23, 1989**

[54] HEAT-SENSITIVE RECORDING MATERIAL

[75] Inventors: Tsunefumi Yamori, Hyogo; Sigekazu Shuku, Nara; Hironari Fujioka, Osaka, all of Japan

[73] Assignee: Kanzaki Paper Mfg. Co., Ltd., Tokyo, Japan

[ * ] Notice: The portion of the term of this patent subsequent to Jul. 20, 1988 has been disclaimed.

[21] Appl. No.: 106,534

[22] Filed: Oct. 9, 1987

[30] Foreign Application Priority Data

Oct. 16, 1986 [JP] Japan ..... 61-246530
Feb. 10, 1987 [JP] Japan ..... 62-29301

[51] Int. Cl.[4] ..... B41M 5/18

[52] U.S. Cl. ..... 503/200; 427/152; 428/913; 428/914; 503/207; 503/226

[58] Field of Search ..... 427/150–152; 503/200, 226, 207; 428/913, 914

[56] References Cited

U.S. PATENT DOCUMENTS 4,370,370 1/1983 Iwata et al. ..... 503/226
4,484,204 11/1984 Yamamoto et al. ..... 503/226

FOREIGN PATENT DOCUMENTS 54-128347 7/1979 Japan ..... 503/200
0199189 11/1983 Japan ..... 503/226
59-26291 10/1984 Japan ..... 503/200
0222383 12/1984 Japan ..... 503/226

*Primary Examiner*—Bruce H. Hess
*Attorney, Agent, or Firm*—Finnegan, Henderson, Farabow, Garrett,& Dunner

[57] ABSTRACT

A heat-sensitive recording material is disclosed, comprising a plastic film or a synthetic paper or a laminate of a plastic film or a synthetic film with a paper; a heat-sensitive recording layer formed on said plastic film or synthetic paper or said laminate, which contains a color former and a color developer which forms a color upon contact with said color former; an interlayer with a Bekk smoothness as defined by TAPPI Standard T479 om-81 of from about 300 to 20,000 seconds formed on said heat-sensitive recording layer, which contains a water-soluble resin or a water-dispersible resin; and an overcoat layer formed on said interlayer, which contains a resin that is curable upon exposure to electron beams.

7 Claims, No Drawings

HEAT-SENSITIVE RECORDING MATERIAL

FIELD OF THE INVENTION

This invention relates to a heat-sensitive recording material and more particularly, to a heat-sensitive recording material which exhibits not only superior recording characteristics in density and gradation but also good preservability of recorded images.

BACKGROUND OF THE INVENTION

Hitherto, a heat-sensitive recording material which utilizes a coloring reaction of a color former and a color developer which forms a color upon contact with the color former and provides a color image by contacting both coloring materials by the action of heat is well known.

Such heat-sensitive recording materials are comparatively inexpensive and can be used on a recording equipment that is compact and requires fairly easy maintenance. Because of these advantages, heat-sensitive recording materials are extensively used not only as recording media in facsimile equipments and various types of computers but also in a wide range of applications including heat-sensitive labels. One major problem with heat-sensitive recording materials is, however, their low resistance to fingerprints or solvents; if the recording layer comes in contact with a sebum of human being or a solvent, the image density of recorded characters is decreased or an unwanted coloration ("background fog") occurs.

With a view to solving this problem, several methods have been proposed; in one method, a heat-sensitive recording layer is coated with an aqueous emulsion of a resin having film-forming properties and resistance to chemicals (Japanese Patent Application (OPI) No. 128347/79) ; and in another method, a heat-sensitive recording layer is coated with a water-soluble high molecular weight compound such as polyvinyl alcohol (Japanese Utility Model Application (OPI) No. 125354/81). (The term "OPI" as used herein means a "published unexamined application".) However, the methods so far proposed either suffer from additional problems or find themselves incapable of achieving the intended results to satisfactory levels. For instance, in the method in which an aqueous resin coating is applied to the heat-sensitive recording layer, the temperature for drying has to be limited to a certain level in order to avoid unwanted coloration of the recording layer due to high-temperature drying, whereby curing of the resin layer inevitably becomes insufficient for preventing its sticking to a recording head during the recording. In order to avoid this problem, a method in which a heat-sensitive recording layer is coated with a resin component capable of curing upon exposure to electron beams and the coated resin component is cured upon exposure to electron beams is proposed. However, the resulting heat-sensitive recording material is still unsatisfactory in terms of preservability of recorded images. In addition, there may also be problems that the electron beam-curable resin layer causes coloration of the heat-sensitive recording layer just after it has been coated or causes fading of recorded images.

In order to solve these problems, the inventors made extensive investigations. As the result, they found that when an interlayer of an aqueous resin is formed on a heat-sensitive recording layer and an overcoat layer containing a resin that is curable upon exposure to electron beams is formed on the interlayer, there is obtained a heat-sensitive recording material which exhibits not only superior recording characteristics as well as widely varying surface characteristics but also good preservability of recorded images without being attended by fogging of the recording layer and, thus, formerly filed Japanese Patent Application No. 124562/86 (corresponding to U.S. application Ser. No. 51,599, filed May 20, 1987).

On the other hand, recently, use has been made of various kinds of printers such as video printers, which can provide images of high qualities comparable to photographs, and even with regard to a heat-sensitive recording material for printing out, it is requested to develop a recording material which is excellent in density as well as gradation of recorded images. For this purpose, heat-sensitive recording materials using a plastic film or a synthetic paper as a support are being developed. But, even in such heat-sensitive recording materials, in order to prevent fading of recorded images, an overcoating such as aqueous resins is applied onto the recording layer.

However, when an overcoat layer is provided on a heat-sensitive recording material using a plastic film or a synthetic paper as a support, it was brought to light that the overcoat layer shows a tendency to stick to a recording head or a paper delivery guide and eventually causes paper jam especially in the case where the recording is carried out under conditions of high humidity. The density of recorded images is also still unsatisfactory.

In view of these circumstances, the inventors further made elaborate investigations to develop a heat-sensitive recording material comparable to a photograph, which is not only especially high in density of recorded images but also excellent in recording characteritics such as gradation. As the result, they have found that when an interlayer having a specified surface smoothness is provided on a recording layer of a heat-sensitive recording material using a plastic film or a synthetic paper as a support and an overcoat layer containing a resin that is curable upon exposure to electron beams is then provided on the interlayer, there is obtainable a heat-sensitive recording material which is not only high in density of recorded images and excellent in gradation and preservability but also is characterized by that it has widely varying surface characteristics as compared with those in the case of ordinary paper being used as a support and shows no sticking to a recording head or the like even when the recording is carried out under conditions of high humidity.

SUMMARY OF THE INVENTION

An object of this invention is to provide a heat-sensitive recording material comprising a plastic film or a synthetic paper; a heat-sensitive recording layer formed on said plastic film or synthetic paper, which contains a color former and a color developer which forms a color upon contact with said color former; an interlayer with a Bekk smoothness as defined by TAPPI Standard T479 om-81 of from about 300 to 20,000 seconds formed on said heat-sensitive recording layer, which contains a water-soluble resin or a water-dispersible resin; and an overcoat layer formed on said interlayer, which contains a resin that is curable upon exposure to electron beams.

DETAILED DESCRIPTION OF THE INVENTION

There is no particular limitation on the possible combination of color formers and color developers that are to be incorporated in the heat-sensitive recording layer of the heat-sensitive recording material of the present invention, and any combination that undergoes a coloring reaction as a result of contact between the both coloring materials by the action of heat may be employed. Illustrative combinations are those of colorless or pale-colored basic dyes and inorganic or organic acidic substances, and those of metal salts of higher fatty acids (e.g., ferric stearate) and phenols (e.g., gallic acid).

Particularly good results are attained in terms of recording characteristics if the overcoat layer specified herein is used with the combination of a basic dye and an acidic substance.

Various types of colorless or pale-colored basic dyes are known. Examples include triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes such as 4,4'-bisdimethylaminobenzhydrylbenzylether, N-halophenyl-leucoauramines, and N-2,4,5-trichlorophenyl-leucoauramine; thiazine-based dyes such as benzoyl-leucomethyleneblue and p-nitrobenzoylleucomethyleneblue; spiro-based dyes such as 3-methylspiro-dinaphthopyran, 3-ethyl-spiro-dinaphthopyran, 3-phenyl-spiro-dinaphthopyran, 3-benzyl-spiro-dinaphthopyran, 3-methylnaphtho(6'-methoxybenzo)spiro-pyran, and 3-propyl-spiro-dibenzopyran; lactam-based dyes such as rhodamine-B-anilinolactam, rhodamine(p-nitroanilino)lactam, and rhodamine(o-chloroanilino)lactam; and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamine 6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-ethyl-N-isoamylamino)-6-methyl 7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, and 3-pyrrolidino-6-methyl-7-p-butylphenylaminofluoran. The present invention is not limited to these exemplified basic dyes. Rather, these basic dyes can be used either alone or in admixture with each other or with other dyes known to be useful in heat-sensitive recording materials.

Various types of inorganic or, organic acidic substances are also known as a color developer which forms a color upon contact with the colorless or pale-colored basic dye. Examples include inorganic acidic substances such as activated clay, acid clay, attapulgite, bentonite, colloidal silica, and aluminum silicate; and organic acidic substances including phenolic compounds such as 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylenebis(4-methyl-6-tertisobutylphenol), 4,4'-isopropylidenebis(2-tert-butylphenol), 4,4'-sec-butylidenediphenol, 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzylether, novolak -type phenol resins, and phenol polymers; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tertbutylsalicylic acid, 3-phenyl-5-(α,αdimethylbenzyl)salicylic acid, and 3,5-di-α-methylbenzylsalicylic acid; and salts of such phenolic compounds or aromatic carboxylic acids with polyvalent metals such as zinc, magnesium, aluminum, calcium, titanium, manganese, tin, and nickel.

The proportion of the color former to the color developer used in the recording layer of the heat-sensitive recording material of the present invention is not limited to any particular values and may be appropriately selected in accordance with the specific types of color former and color developer employed. As a guide, from about 1 to 50 parts by weight, preferably from about 1 to 10 parts by weight, of the acidic substance may be used per part by weight of the colorless or pale-colored basic dye.

A coating composition containing these substances may be prepared by dispersing the above-listed color former and color developer, either as an admixture or independently, in a dispersion medium, which is typically water, by means of a suitable stirrer/grinder such as a ball mill, an attritor, or a sand mill.

The coating composition may contain a binder in an amount of from about 10 to 40 wt %, preferably from 15 to 30 wt %, of the total solids content of the coating composition. An appropriate binder is selected from among: starches, hydroxyethyl cellulose, methyl cellulose, carboxymethyl cellulose, gelatin, casein, gum arabic, polyvinyl alcohol, diisobutylene/maleic anhydride copolymer salts, styrene/maleic anhydride copolymer salts, ethylene/acrylic acid copolymer salts, styrene/acrylic acid copolymer salts, and styrene/butadiene copolymer emulsions.

The coating composition may further contain a variety of auxiliary agents such as dispersants (e.g., sodium dioctylsulfosuccinate, sodium dodecylbenzenesulfonate, sodium salts of lauryl alcohol sulfuric acid esters, alginic acid salts, and metal salts of fatty acids), ultraviolet light absorbers (e.g., benzophenone or triazole-based compounds), defoaming agents, fluorescent dyes, and coloring dyes.

Other additives that may be incorporated in the coating composition include: lubricants such as zinc stearate, calcium stearate, polyethylene wax, carnauba wax, paraffin wax, and ester waxes; inorganic pigments such as kaolin, clay, talc, calcium carbonate, calcined clay, titanium oxide, diatomaceous earth, fine granular anhydrous silica, and activated clay; and sensitizers such as stearic acid amide, stearic acid methylenebisamide, oleic acid amide, palmitic acid amide, sperm oleic acid amide, and coconut fatty acid amide.

As the support in the heat-sensitive recording material of this invention, there can be used a plastic film or a synthetic paper. However, the support as referred to herein also includes a laminate of a plastic film or a synthetic paper with a paper (such as a wood-free paper or a coated paper). Examples of plastic films include films of polyethylene, polyesters, polyvinyl chloride, polystyrene, nylons, etc. Synthetic papers which can be used may be divided into two groups manufactured by a film process and a fiber process. The film process includes an internal paper-making process wherein a synthetic resin is melt kneaded together with fillers and additives and then extruded to form a film; a surface coating process wherein a pigment coating layer is provided; and a surface treating process. Further, synthetic papers made by the fiber process include synthetic pulp paper, spun bond paper, etc. Among these supports, plastic films and synthetic papers by the film process are preferable because they can provide particularly excellent recording characteristics.

There is no particular limitation to the method for coating of the recording layer, and any conventional techniques can be used. For instance, the recording layer can be formed by coating a coating composition by such methods as bar coating, air-knife coating, rod blade coating, pure blade coating, short-dwell coating, etc., followed by drying. In addition, when a plastic film is used as a support, the coating efficiency may be enhanced by subjecting its surface to corona discharge, irradiation with electron beams, or the like. The amount in which the coating composition is applied is not limited to any particular value, but it generally ranges from about 2 to 12 g/m$^2$, preferably from 3 to 10 g/m$^2$, on a dry weight basis.

In accordance with the present invention, the heat-sensitive recording layer thus formed is then coated with an interlayer having a specified surface smoothness. Suitable examples of the water-soluble resin or water-dispersible resin to be incorporated in the interlayer include completely or partially saponified polyvinyl alcohols; acetoaceylated polyvinyl alcohols in which an acetoacetyl group has been introduced by reaction between polyvinyl alcohol and diketene, etc.; reaction products of polyvinyl alcohol and polycarboxylic acids such as fumaric acid, phthalic anhydride, trimellitic anhydride, and itaconic anhydride, or esterified products of these reaction products; carboxy-modified polyvinyl alcohols obtained as saponification products of copolymers of vinyl acetate and ethylenically unsaturated carboxylic acids such as maleic acid, fumaric acid, itaconic acid, crotonic acid, acrylic acid, and methacrylic acid; sulfonic acid-modified polyvinyl alcohols obtained as saponification products of copolymers of vinyl acetate and olefinic sulfonic acids such as ethylenesulfonic acid and allylsulfonic acid or salts thereof; olefin-modified polyvinyl alcohols obtained by saponifying copolymers of vinyl acetate and olefins such as ethylene, propylene, isobutylene, $\alpha$-octene, $\alpha$-dodecene, and $\alpha$-octadodecene; nitrile-modified polyvinyl alcohols obtained as saponification products of copolymers of vinyl acetate and nitriles such as acrylonitrile and methacrylonitrile; amide-modified polyvinyl alcohols obtained by saponifying copolymers of vinyl acetate and amides such as acrylamide and methacrylamide; pyrrolidone-modified polyvinyl alcohols obtained by saponifying copolymers of vinyl acetate and N-vinylpyrrolidone; cellulose derivatives such as methyl cellulose, ethyl cellulose, hydroxyethyl cellulose, and carboxymethyl cellulose; casein; gum arabic; starches such as oxidized starch, etherified starch, dialdehyde starch, and esterified starch; a styrene/butadiene copolymer emulsion; a vinyl acetate/vinyl chloride/ethylene copolymer emulsion; and a methacrylate/butadiene copolymer emulsion.

Among these water-soluble or water-dispersible resins, the water-soluble resins are preferable from the viewpoint of sticking characteristics and resistance to plasticizer and above all, various modified polyvinyl alcohols, cellulose derivatives, and casein are more preferable, with acetoacetylated polyvinyl alcohols and carboxy-modified polyvinyl alcohols being most preferable.

Pigments may be incorporated in the interlayer in order to increase its smoothness. Specific examples of useful pigments include inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, and colloidal silica; and organic pigments such as micro balls of polystyrene, nylon powder, polyethylene powder, urea/formaldehyde resin filler, and raw starch granules. These pigments are generally incorporated in the interlayer in amounts of from about 5 to 500 parts by weight, preferably from 80 to 350 parts by weight, based on 100 parts by weight of the resin component.

The coating composition for forming the interlayer may optionally contain a curing agent selected from among, for example, glyoxal, methylolmelamine, potassium persulfate, ammonium persulfate, sodium persulfate, ferric chloride, magnesium chloride, boric acid, and ammonium chloride. If required, the coating composition may further contain a variety of auxiliary agents such as lubricants (e.g., zinc stearate, calcium stearate, stearic acid amide, polyethylene wax, carnauba wax, paraffin wax, and ester waxes), surfactants (e.g., sodium dioctylsulfosuccinate, sodium dodecylbenzenesulfonate, sodium salts of lauryl alcohol sulfuric acid esters, alginic acid salts, and metal salts of fatty acids), ultraviolet light absorbers (e.g., benzophenone- or triazole-based compounds), defoaming agents, fluorescent dyes, and coloring dyes.

The coating composition for forming the interlayer is generally prepared as an aqueous system and, after optional mixing by means of a suitable mixer/stirrer such as a mixer, an attritor, ball mill, or a roll mill to obtain a desired dispersion, the coating composition is applied onto the heat-sensitive recording layer by any known coating methods. After its application, the interlayer is dried by conventional drying means or by exposure to ultraviolet rays or electron beams.

If a curing agent is used in combination, it may be incorporated in the coating composition for forming the interlayer. Alternatively, the curing agent may be coated separately from the coating composition for forming the interlayer, and this has the advantage of permitting a strong curing agent to be selected without worrying about the pot life of the coating composition.

If desired, a coating layer of the same type as the interlayer may be formed on the back side of the support comprised of a plastic film or a synthetic paper for the purpose of providing it with enhanced preservability of recorded images. Any of the processing techniques known in the art of manufacturing heat-sensitive recording materials may additionally be performed. For instance, a resin which is non-curable or curable upon exposure to electron beams may be coated on the back side of a support so as to prevent the recording material from occurrence of curling; the recording material may be subjected to electroconductive processing so as to enhance the running properties; a subbing layer may be formed on a support; or an adhesive may be applied to the back side of the recording material so as to make an adhesive label.

The amount in which the coating composition for forming the interlayer is applied is not limited to any particular value. However, if the coating composition is applied in an amount of less than about 0.1 $g/m^2$, the intended effects of the present invention are not fully attained. If the coating composition is applied in an amount exceeding about 20 $g/m^2$, the recording sensitivity of the resulting heat-sensitive recording material may be reduced markedly. Therefore, the coating composition for the interlayer is generally applied in an amount of from about 0.1 to 20 $g/m^2$, preferably from 0.5 to 10 $g/m^2$, on a dry basis.

In the heat-sensitive recording material of this invention, the smoothness of the interlayer thus formed is of critical importance. If the Bekk smoothness (as defined by TAPPI Standard T479 om-81) of the interlayer is less than about 300 seconds, no satisfactory image density can be obtained even when a resin that is curable upon exposure to electron beams is provided, and moreover, owing to somewhat unfavoured barrier properties of the interlayer, the preservability of recorded characters is reduced. Whereas, if the smoothness of the interlayer is too high, an overcoat layer cannot be brought into intimate contact with the interlayer, so that the surface strength of the overcoat layer is not sufficient. This implies that there is a possibility that the surface may peel apart and the resistance to plasticizer becomes poor. But, different from the case in use of ordinary paper, in the case where a plastic film or a synthetic paper is used, unless the Bekk smoothness of the interlayer exceeds as high a smoothness as about 20,000 seconds, no lowering of the surfaces strength is appreciable. Therefore, the Bekk smoothness of the interlayer in the heat-sensitive recording material of this invention is adjusted so as to be from about 300 to 20,000 seconds, preferably from 1,000 to 20,000 seconds, and most preferably from 3,000 to 20,000 seconds, and as occasion demands, supercalendering or other means may be used for further smoothening treatment of the surface.

The reasons why the overcoat layer can have sufficient surface strength even if the smoothness of the interlayer is considerably high in the case where a plastic film or a synthetic paper is used as a support is not always clear. However, in the case where ordinary paper is used as a support, measurement of the Bekk smoothness gives low values because air flows not only over the surface to be measured but also through the paper itself, and moreover, on account of the fact that paper readily absorbs the binder in the coating composition, ordinary paper inevitably indirectly affects the surface properties of the interlayer, whereas a plastic film or a synthetic paper has almost no such effect, and therefore, it is presumed that these may be the causes.

In the heat-sensitive recording material of the present invention, the interlayer thus formed which has the surface smoothness specified hereinabove is overcoated with a layer of a resin that is curable upon exposure to electron beams. This resin overcoat layer is formed of one or more of the following prepolymers or monomers having at least one ethylenically unsaturated double bond in the molecule, that cure upon exposure to electron beams.

Examples of useful electron beam-curable prepolymers include:

(a) Poly(meth)acrylates of aliphatic, alicyclic, or araliphatic polyhydric (having from 2 to 6 alcoholic hydroxyl groups) alcohols or polyalkylene glycols, such as esterified compounds of polyhydric alcohols (e.g., ethylene glycol and propylene glycol) or polyalkylene glycols (e.g., polyethylene glycol) and (meth)acrylic acid;

(b) Poly(meth)acrylates of polyhydric alcohols resulting from addition of alkylene oxides to aliphatic, alicyclic, or araliphatic polyhydric (having from 2 to 6 alcoholic hydroxyl groups) alcohols, such as esterified compounds of polyhydric alcohols resulting from addition of alkylene oxides (e.g., ethylene oxide) to polyhydric alcohols (e.g., pentaerythritol) and (meth)acrylic acid;

(c) Poly(meth)acryloyloxyalkyl phosphates resulting from reaction of hydroxyl group-containing (meth)acrylates and phosphorus pentoxide, e.g., poly(meth)acryloyloxyethyl phosphate;

(d) Polyester poly(meth)acrylates resulting from esterification of (meth)acrylic acid, polyhydric alcohols, and polycarboxylic acids, e.g., di(meth)acrylate of polyester diol between maleic acid and ethylene glycol, di(meth)acrylate of polyester diol between phthalic acid and diethylene glycol, and poly(meth)acrylate of polyester diol between adipic acid and triethylene glycol;

(e) Epoxy poly(meth)acrylates which are a reaction product of (meth)acrylic acid and epoxy resin resulting from reaction of polyhydric phenols and epichlorohydrin, e.g., a reaction product of bisphenol A-diglycidyl ether-based epoxy resin and (meth)acrylic acid;

(f) Polyurethane poly(meth)acrylates such as reaction products of hydroxyl group-containing (meth)acrylates (e.g., 2-hydroxyethyl (meth)acrylate) and diisocyanate;

(g) Polyamide poly(meth)acrylates such as reaction products of polyamide-based polycarboxylic acids (e.g., that resulting from reaction of ethylenediamine and phthalic acid) and hydroxyl group-containing (meth)acrylates (e.g., 2-hydroxyethyl (meth)acrylate);

(h) Polysiloxane poly(meth)acrylates such as reaction products of polysiloxane bond unit-containing polyhydric alcohols and (meth)acrylic acid or hydroxyl group-containing (meth)acrylates;

(i) Low-molecular weight vinyl or diene polymers containing (meth)acryloyloxy group in the side chain and/or terminal thereof, such as reaction products of copolymers of (meth)acrylic acid and other vinyl monomer and glycidyl (meth)acrylate; and (j) Modified products of the oligoester (meth)acrylates of (a) to (i) above, such as modified products obtained by modifying a part of the hydroxyl or carboxyl groups remained in the oligoester with an acid chloride, an acid anhydride, or an isocyanate.

Examples of useful electron beam-curable monomers include:

I. Monofunctional Unsaturated Monomers (1) Carboxyl group-containing monomers exemplified by ethylenically unsaturated mono- or polycarboxylic acids (e.g., maleic acid, fumaric acid, and itaconic acid), and carboxylic acid salt group-containing monomers such as alkali metal salts, ammonium salts, and amine salts of the foregoing monomers;

(2) Amide group-containing monomers exemplified by ethylenically unsaturated (meth)acrylamides or alkyl substituted (meth)acrylamides (e.g., N,N-dimethyl (meth)acrylamide), and vinyl lactams (e.g., N-vinylpyrrolidone);

(3) Sulfonic acid group-containing monomers exemplified by aliphatic or aromatic vinylsulfonic acids, and sulfonic acid salt group-containing monomers such as the alkali metal, ammonium, and amine salts of the foregoing vinylsulfonic acids, e.g., 2-acrylamido-2-methylpropanesulfonic acid;

(4) Hydroxyl group-containing monomers exemplified by ethylenically unsaturated esters of polyols, such as tripropylene glycol mono(meth)acrylate;

(5) Amino group-containing monomers such as dimethylaminoethyl (meth)acrylate and 2-vinylpyridine;

(6) Quaternary ammonium salt group-containing monomers such as N,N,N-trimethyl-N-(meth)acryloyloxyethylammonium chloride;

(7) Alkyl esters of ethylenically unsaturated carboxylic acids, such as methyl (meth)acrylate and ethyl (meth)acrylate;

(8) Nitrile group-containing monomers such as (meth)acrylonitrile;

(9) Styrene;

(10) Ethylenically unsaturated alcohol esters such as vinyl acetate and allyl acetate; and

(11) Mono(meth)acrylates of alkylene oxide adducts of compounds containing active hydrogen (e.g., monohydric alcohols, phenols, carboxylic acids, amines, and amides).

II. Difunctional Unsaturated Monomers (1) Ester group-containing difunctional monomers exemplified by diesters of polyols and ethylenically unsaturated carboxylic acids, such as trimethylolpropane di(meth)acrylate, and diesters of polybasic acids and unsaturated alcohols, such as diallyl phthalate;

(2) Difunctional diesters of (meth)acrylic acid and alkylene oxide adducts of compounds containing active hydrogen (e.g., polyhydric alcohols, phenols, carboxylic acids, amines, and amides) such as pentanediol propylene oxide adduct;

(3) Bisacrylamides such as N,N-methylenebisacrylamide; and (4) Difunctional compounds such as divinylbenzene, divinylethylene glycol, divinylsulfone, divinyl ether, and divinyl ketone.

III. Polyfunctional Unsaturated Monomers (1) Ester group-containing polyfunctional monomers exemplified by polyesters of polyols and ethylenically unsaturated carboxylic acids, such as trimethylolpropane (meth)acrylate and dipentaerythritol hexa(meth)acrylate, and polyesters of polycarboxylic acids and unsaturated alcohols, such as triallyl trimellitate;

(2) Polyfunctional monomers exemplified by polyesters of alkylene oxide adducts of compounds containing active hydrogen (e.g., polyhydric alcohols, polyhydric phenols, polycarboxylic acids, polyamines, and polyamides) and (meth)acrylic acid; and (3) Polyfunctional unsaturated monomers such as trivinylbenzene.

With the development of high-speed recording equipments such as a video printer, there may occur a phenomenon such that the overcoat layer sticks to a recording head even when a resin that is curable upon exposure to electron beams is used for the overcoat layer. Such a sticking phenomenon occurs even when laid not under conditions of high humidity. However, in order to prevent such a sticking phenomenon to the recording head in high-speed recording, it is preferable that the overcoat layer provided on the interlayer is formed mainly of such a resin that is curable upon exposure to electron beams and has a glass transition point ($T_g$) after the curing of about 150° C. or higher, preferably 200° C. or higher. In this case, however, from the consideration of possible abrasion of the thermal head, use of a resin having a $T_g$ of not higher than about 500° C. is preferable.

In general, an overcoat layer having a high crosslinking density can be obtained from a resin that is curable upon exposure to electron beams and which has many carbon-to-carbon double bonds capable of generating a radical in one molecule, whereby the $T_g$ shows a tendency to increase.

For instance, excellent heat-sensitive recording materials can be obtained by curing polyfunctional monomers such as diacryloxyethyl tricyanurate, pentaerythritol triacrylate, trimethylolpropane triacrylate, dipentaerythritol hexaacrylate, tris(acryloxyethyl)isocyanurate, etc., or tetrafunctional or higher oligoester acrylates represented by the following formula by electron beams.

$$A-\left(\overset{\overset{A}{|}}{X}-Y\right)_n\overset{\overset{A}{|}}{X}-A$$

In the formula, A represents acrylic acid; X represents a polyhydric alcohol; Y represents a polybasic acid; and n represents an integer of from 1 to 20.

In the above-described formula, examples of polyhydric alcohols include ethylene glycol, propylene glycol, diethylene glycol, dipropylene glycol, neopentyl glycol, triethylene glycol, glycerin, trimethylolpropane, petaerythritol, bisphenol A, etc; and examples of polybasic acids include unsaturated polybasic acids (such as maleic acid, fumaric acid, itaconic acid, carbic acid, mesaconic acid, citraconic acid, dichloromaleic acid, chloromaleic acid, etc.) and saturated polybasic acids (such as succinic acid, glutaric acid, adipic acid, phthalic acid,, isophthalic acid, terephthalic acid, trimellitic acid, chlorophthalic acid, hydrophthalic acid, etc.).

In addition, from the viewpoints of viscosity of the coating composition and sticking characteristics, pentaerythritol triacrylate is most preferable. If desired, the above-described polyfunctional monomers and oligoester acrylates can be used in combination of two or more thereof.

The amount in which the electron beam-curable resin is coated is not limited to any particular value. However, if this resin is coated in an amount of less than about 0.1 g/m$^2$, the intended effects of the present invention cannot be attained. If the resin is coated in an amount of more than about 20 g/m$^2$, the recording sensitivity of the resulting heat-sensitive recording material may be reduced markedly. Therefore, the electron beam-curable resin is generally coated in an amount of from about 0.1 to 20 g/m$^2$, preferably from 0.3 to 10 g/m$^2$.

Besides the prepolymers, monomers and oligomers described above, various additives may optionally be incorporated in the resin component that cures upon exposure to electron beams, and such optional additives include resins that do not cure upon exposure to electron beams, pigments, coloring pigments, fluorescent pigments, phosphorescent dyes, other organic pigments, defoaming agents, levelling agents, lubricants, surfactants plasticizers, and ultraviolet light absobers.

When a fine powder of silicone resin is incorporated in the overcoat layer, the sticking phenomenon to the recording head can be prevented even in high-speed recording.

The fine powder of silicone resin which is used in this invention is a fine powder prepared by dehydrating and condensing a silanol compound produced by dispersing, for example, a polyfunctional organochlorosilane (e.g., a polyfunctional alkylchlorosilane) or a polyfunctional alkylalkoxysilane in water and then removing off water and which has a network structure in which the siloxane bonds extend in the three-dimensional state. Among such fine powders of silicone resin, a trifunctional condensate of methylsilicone is preferable because it is excellent in the desired effects of this invention.

Such a silicone resin is formed in a state of fine particle, whose particle diameter is preferably from about 0.05 to 15 μm.

If the amount of the fine powder of silicone resin incorporated in the overcoat layer is small, no effect is appreciable, while it is large, the image density and gradation decrease. Thus, it is usually from about 0.01 to 15 parts by weight based on 100 parts by weight of the resin curable by electron beams.

Since in the heat-sensitive recording material of this invention, a plastic film or a synthetic paper is used as a support, the surface having a higher gloss than that in the case of ordinary paper can be obtained. But, by suitably selecting the types and proportions of such additives used, heat-sensitive recording materials with widely varying surface properties ranging from a high gloss to a matted appearance can be attained.

Illustrative resins that do not cure upon exposure to electron beams include acrylic resins, silicone resins, alkyd resins, fluorocarbon resins, and polyvinyl butyral resins.

The electron beam-curable resin and any other necessary components are intimately mixed by means of a suitable mixer/stirrer such as a mixer, and the resulting mixture is coated on the previously formed interlayer. If necessary, the resin components may be heated to attain a properly adjusted viscosity.

The resin layer formed on the interlayer is then cured by exposure to electron beams, the dose of which generally ranges from about 0.1 to 15 Mrad, preferably from 0.5 to 10 Mrad. The resin component cannot be fully cured if the dose of electron beams is less than about 0.1 Mrad. If, on the other hand, the dose of electron beams exceeds about 15 Mrad, the heat-sensitive recording material undergoes undesired color formation or discoloration. As the dose of electron beams is high, the cross-linking density increases, whereby the glass transition point can be increased.

Exposure to electron beams may be carried by any conventional technique such as the scanning method, the curtain-beam method, or the broad-beam method. An appropriate acceleration voltage for electron beam exposure ranges from about 100 to 300 kV.

Further, by subjecting the overcoat layer thus formed to a surface smoothening treatment by means of supercalendering or the like, there is obtainable an excellent heat-sensitive recording material which is free from unevenness in density of recorded images.

The following examples are provided for the purpose of further illustrating the present invention but are in no sense to be taken as limiting. In the following examples, all parts and percents are on a weight basis unless otherwise specified.

EXAMPLE 1

(1) Preparation of Dispersion A:

| | |
|---|---|
| 3-(N—Cyclohexyl-N—methylamino)-6-methyl-7-phenylaminofluoran | 10 parts |
| Methyl celluolse (5% aq. sol.) | 5 parts |
| Water | 30 parts |

A mixture of these components was pulverized by means of a sand mill to an average particle diameter of 3 μm.

(2) Preparation of Dispersion B:

| | |
|---|---|
| Benzyl 4-hydroxybenzoate | 20 parts |
| Methyl cellulose (5% aq. sol.) | 5 parts |
| Water | 55 parts |

A mixture of these components was pulverized by means of a sand mill to an average particle diameter of 3 μm.

(3) Formation of Recording Layer:

Forty-five parts of Dispersion A, 80 parts of Dispersion B, 50 parts of an aqueous solution of 20% oxidized starch, and 10 parts of water were mixed under agitation to make a coating composition. This coating composition was coated on a synthetic paper with a basis weight of 80 g/m$^2$ (Yupo ®, a trade name of Oji-Yuka Synthetic Paper Co., Ltd.) in a dry coating weight of 6 g/m$^2$ and subsequently dried to make a heat-sensitive recording material.

(4) Formation of Interlayer:

A coating composition having the composition shown below was applied to the recording layer of the heat-sensitive recording material in a dry coating weight of 4 g/m$^2$ and subsequently dried to form an interlayer having a Bekk smoothness as defined by TAPPI Standard T479 om-81 (hereinafter the same) of 150 seconds.

| | |
|---|---|
| Polyvinyl alcohol (PVA-117 ®, a trade name of Kuraray Co., Ltd.) (8% aq. sol.) | 1,000 parts |
| Calcium carbonate (Softon ® 1800, a trade name of Bihoku Funka K.K.) | 100 parts |
| Water | 100 parts |

The resulting interlayer was supercalendered to provide a Bekk smoothness of 5,000 seconds.

(5) Formation of Overcoat Layer:

The interlayer was overcoated with a prepolymer mixture of polyester polyacrylate and polyurethane polyacrylate (78 E204 ®, a trade name of Mobil Oil Corp.) in a dry coating weight of 5 g/m$^2$. The resin components in the applied layer were cured by exposure to electron beams for a total dose of 3 Mrad with an electron curtaintype electron beam irradiator (Model CB:150 of ESI Corporation). As a result, a heat-sensitive recording material with an overcoat layer of electron beam-cured resin was produced.

EXAMPLE 2

A heat-sensitive recording material with an overcoat layer of electron beam-cured resin was formed as in Example 1 except that the polyvinyl alcohol used as the water-soluble high-molecular weight compound in the interlayer was replaced by an acetoacetylated polyvinyl alcohol (Z-200®, a trade name of The Nippon Synthetic Chemical Industry Co., Ltd.).

EXAMPLE 3

A heat-sensitive recording material with an overcoat layer of electron beam-cured resin was formed as in Example 1 except that the interlayer was supercalendered to attain a Bekk smoothness of 10,000 seconds.

COMPARATIVE EXAMPLE 1

A heat-sensitive recording material was prepared as in Example 1 except that the initially formed interlayer having a Bekk smoothness of 150 seconds was not supercalendered and was immediately provided with an overcoat layer of electron beam-cured resin.

COMPARATIVE EXAMPLE 2

A heat-sensitive recording material with an overcoat layer of electron beam-cured resin was prepared as in Example 1 except that the interlayer was supercalendered to have a Bekk smoothness of 30,000 seconds.

COMPARATIVE EXAMPLE 3

A heat-sensitive recording material was prepared as in Example 1 except that no overcoat layer was formed on the interlayer.

COMPARATIVE EXAMPLE 4

A heat-sensitive recording material was prepared as in Example 1 except that the prepolymer mixture of polyester polyacrylate and polyurethane polyacrylate used as the overcoat layer-forming resin was replaced by an ultraviolet light-curable resin (a mixture of acrylate prepolyemr and photosensitizer: UV-Cote® 50 P-326, a trade name of Nippon Paint Co., Ltd.) and that exposure to electron beams was replaced by a 5-second exposure to ultraviolet light radiation under a high pressure mercury vapor lamp (80 watts).

COMPARATIVE EXAMPLE 5

A heat-sensitive recording material was prepared as in Example 1 except that in place of the synthetic paper as a support for forming the recording layer, an ordinary paper having a basis weight of 50 g/m$^2$ was used and that the surface of the interlayer was smoothened so as to have a Bekk smoothness of 500 seconds.

Eight samples of heat-sensitive recording material thus obtained were recorded with s video printer, Model UP103 (manufactured by Sony Corporation), and the initial color densities of the recorded images were measured with a Macbeth densitometer (Model RD-100R, manufactured by Macbeth Corp.). The results are shown in Table 1.

These samples were further tested for the color density after plasticizer-resistant treatment, the sticking characteristics of coated layer, and the surface strength. The results of these tests are shown in Table 1, in which the gloss of the surface of each sample measured before recording is also shown together.

Resistance to Plasticizer:

A polypropylene pipe (40 mmϕ) was wrapped with three layers of polyvinyl chloride wrap film (manufactured by Mitsui Toatsu Chemicals, Inc.), and a sample of heat-sensitive recording material on which an image had been recorded with a video printer was placed over the PVC wrap film with the recorded side facing outward; the heat-sensitive recording material was further wrapped with five layers of PVC wrap film, and the color density of the recorded image was measured 72 hours later (the higher the color density, the more resistant to plasticizer the sample was).

Sticking Characteristics of Coated Layer:

After 0.05 ml of water had been dropped on the coated surface of a heat-sensitive recording material, these coated surface of the same heat-sensitive recording material was superposed in a face-to-face relation. They were placed for one minute under a pressure of 20 g/cm$^2$ and then peeled apart, to visually evaluate the peeling state of the surface.

O: Coated layer showed nothing abnormal.

x: Peeling occurred in the coated layer.

Surface Strength:

A cellophane adhesive tape (manufactured by Nitto Electric Industrial Co., Ltd.) was stuck onto the surface of the coated layer and then peeled apart therefrom, to visually evaluate the peeling state of the resulting surface layer.

O: The surface layer showed nothing abnormal.

x: Peeling occurred in the surface layer.

Gloss:

Measured with a varied-angle photometer at an incident angle of 60°. (The higher the vauue, the higher the gloss.)

TABLE 1

| | Initial Color Density of Recorded Image | Resistance to Plasticizer | Sticking Characteristics of Coated Layer | Surface Strength | Gloss |
|---|---|---|---|---|---|
| Example 1 | 1.80 | 1.77 | O | O | 95 |
| Example 2 | 1.80 | 1.79 | O | O | 95 |
| Example 3 | 1.82 | 1.78 | O | O | 97 |
| Comparative Example 1 | 1.55 | 1.45 | O | O | 70 |
| Comparative Example 2 | 1.80 | 1.40 | O | x | 95 |
| Comparative Example 3 | 1.30 | 1.10 | x | O | 8 |
| Comparative Example 4 | 1.50 | 1.25 | O | O | 55 |
| Comparative | 1.27 | 1.25 | O | O | 90 |

TABLE 1-continued

| | Initial Color Density of Recorded Image | Resistance to Plasticizer | Sticking Characteristics of Coated Layer | Surface Strength | Gloss |
|---|---|---|---|---|---|
| Example 5 | | | | | |

As clearly seen from Table 1, the heat-sensitive recording materials of this invention were high in color density of the recorded image having an excellent surface gloss and extremely excellent in preservability of the recorded image showing no sticking of the surface.

EXAMPLE 4

A heat-sensitive recording material having an overcoat layer of an electron beam-curable resin ($T_g$. 250° C.) was prepared as in Example 1 except that in place of the prepolymer mixture of polyester polyacrylate and polyurethane polyacrylate, pentaerythritol triacrylate (Aronix® M-305, a trade name of Toagosei Chemical Industry Co., Ltd.) was used.

EXAMPLE 5

A heat-sensitive recording material having an overcoat layer of an electron beam-curable resin ($T_g$: 250° C.) was prepared as in Example 4 except that in place of the pentaerythritol triacrylate as the resin for forming an overcoat layer, trimethylolpropane triacrylate (Aronix® M-309, a trade name of Toagosei Chemical Industry Co., Ltd.) was used.

EXAMPLE 6

A heat-sensitive recording material having an overcoat layer of an electron beam-curable resin ($T_g$: 250° C.) was prepared as in Example 4 except that in place of the pentaerythritol triacrylate as the resin for forming an overcoat layer, oligoester acrylate (M-8030®, a trade name of Toagosei Chemical Industry, Co., Ltd.) was used.

EXAMPLE 7

A heat-sensitive recording material having an overcoat layer of an electron beam-curable resin ($T_g$: 180° C.) was prepared as in Example 6 except that the dose of electron beams was taken to be 1 Mrad.

EXAMPLE 8

A heat-sensitive recording material having an overcoat layer was prepared as in Example 7 except that one part by weight of a fine powder of silicone resin (Tospearl®, a trade name of Toshiba Silicone Co., Ltd.) was added to 100 parts by weight of the electron beam-curable resin.

EXAMPLE 9

A heat-sensitive recording material having an overcoat layer of an electron beam-curable resin ($T_g$: 90° C.) was prepared as in Example 4 except that in place of the pentaerythritol triacrylate as the resin for forming an overcoat layer, tripropylene glycol diacrylate (M-220®, a trade name of Toagosei Chemical Industry Co., Ltd.) was used.

Six samples of heat-sensitive recording material thus obtained were recorded with a video printer, Model UP 103 (manufactured by Sony Corporation), and running characteristics (sticking characteristics) of the recording material and the initial color density of the recorded image were evaluated by means of a Macbeth densitometer (Model RD-100R, manufactured by Macbeth Corp.). The results are shown in Table 2.

Further, the color density after plasticizer-resistant treatment by the above-described method and the surface gloss of the heat-sensitive recording material before recording were also measured. These results are also shown in Table 2.

Evaluation Criteria of Sticking Characteristics

A: Even in high-speed recording, the running was extremely smooth without causing sticking to the recording head at all.

B: The running of the recording material in high-speed recording was smooth.

C: The recording material was found to stick to the recording head occasionally showing a tendency to cause poor running.

TABLE 2

| | Running Characteristics of Recording Material | Initial Color Density of Recorded Image | Resistance to Plasticizer | Gloss |
|---|---|---|---|---|
| Example 4 | A | 1.90 | 1.88 | 97 |
| Example 5 | A | 1.85 | 1.82 | 95 |
| Example 6 | A | 1.85 | 1.82 | 95 |
| Example 7 | B | 1.84 | 1.81 | 95 |
| Example 8 | A | 1.84 | 1.81 | 95 |
| Example 9 | C | 1.80 | 1.76 | 95 |

As clearly seen from Table 2, the heat-sensitive recording materials of this invention not only have superior running characteristics in recording and high color density of recorded image but also are excellent in surface gloss and preservability of the recorded image. While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a plastic film or a synthetic paper of a laminate of a plastic film or a sythetic film with a paper; a heat-sensitive recording layer formed on said plastic film or synthetic paper or said laminate, which contains a color former and a color developer which forms a color upon contact with said color former; an interlayer with a Bekk smoothness as defined by TAPPI Standard T479 om-81 of from about 300 to 20,000 seconds formed on said heat-sensitive recording layer, which contains a water-soluble resin or a water-dispersible resin; and an overcoat layer formed on said interlayer, said overcoat layer comprising a resin which has been cured by exposure to electron beams.

2. A heat-sensitive recording material as in claim 1, wherein said resin which has been cured by exposure to electron beams has a glass transition temperature, $T_g$, of about 150° C. of higher.

3. A heat-sensitive recording material as in claim 2, wherein said resin which has been cured by exposure to electron beams comprises, prior to being cured by exposure to electron beams, at least one poly-functional monomer selected from pentaerythritol triacrylate, trimethylolpropane triacrylate, dipentaeerythritol hexacrylate, and tris (acryloxyethyl) isocyanurate.

4. A heat-sensitive recording material as in claim 3, wherien said resin which has been cured by exposure to electron beams comprises, prior to being cured by exposure to electron beams, pentaerythritol triacryalte.

5. A heat-sensitive recording material as in claim 2, wherein said resin which has been cured by exposure to electron beams comprises, prior to being cured by exposure to electron beams, at least one oligoester acrylate represented by the following formula:

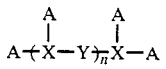

wherein A represents acrylic acid; X represents a polyhydric alcohol; Y represents a polybasic acid; and n represents an interger of from 1 to 20.

6. A heat-sensitive recording material as in claim 1, wherein said interlayer has a Bekk smoothness as defined by TAFPI Standard T479 om-81 of from 1,000 to 20,000 seconds.

7. A heat-sensitive recording material as in claim 1, wherein said overcoat layer compirses, in addition, prior to exposure to electron beams, a fine powder of silicone resin.

* * * * *

UNITED STATES PATENT AND TRADEMARK OFFICE

CERTIFICATE OF CORRECTION

PATENT NO. : 4,833,116

DATED : May 23, 1989

INVENTOR(S) : Tsunefumi Yamori et al.

It is certified that error appears in the above-identified patent and that said Letters Patent is hereby corrected as shown below:

Claim 1, column 16, line 51, change "sythetic" to --synthetic--.

Claim 3, column 17, line 5, change "dipentaeerythritol" to --dipentaerythritol--.

Claim 4, column 17, line 8, change "wherien" to --wherein--.

Claim 5, column 18, line 8, change "interger" to --integer--.

Claim 6, column 18, line 11, change "TAFPI" to --TAPPI--.

Signed and Sealed this

Twelfth Day of June, 1990

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,833,116

DATED : May 23, 1989

INVENTOR(S) : Tsunefumi Yamori; Sigekazu Shuku; and Hironari Fujioka

It is certified that error appears in the above-identified patent and that said Letters Patent is hereby corrected as shown below:

On the title page:

In the Notice of Terminal Disclaimer:

change "Jul. 20, 1988" to --Mar. 14, 2006--.

Signed and Sealed this

Twelfth Day of March, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,833,116

DATED : May 23, 1989

INVENTOR(S) : Tsunefumi Yamori et al.

It is certified that error appears in the above-identified patent and that said Letters Patent is hereby corrected as shown below:

Claim 2, column 16, line 66, change " 150° C. of higher" to --150° or higher--.

Signed and Sealed this

Seventh Day of October, 1997

*Attest:*

Bruce Lehman

BRUCE LEHMAN

*Attesting Officer*

*Commissioner of Patents and Trademarks*